US007478443B2

(12) United States Patent
Schneider et al.

(10) Patent No.: US 7,478,443 B2
(45) Date of Patent: Jan. 20, 2009

(54) APPARATUS FOR FITTING A SINK TO A WORKTOP

(75) Inventors: Wolfgang Schneider, Eppingen (DE); Michael Osterroth, Waghäusel (DE)

(73) Assignee: Blanco GmbH + Co KG, Oberderdingen (DE)

( * ) Notice: Subject to any disclaimer, the term of this patent is extended or adjusted under 35 U.S.C. 154(b) by 0 days.

(21) Appl. No.: 11/403,315

(22) Filed: Apr. 13, 2006

(65) Prior Publication Data

US 2006/0253974 A1 Nov. 16, 2006

Related U.S. Application Data

(63) Continuation of application No. PCT/EP2004/012840, filed on Nov. 12, 2004.

(30) Foreign Application Priority Data

Nov. 25, 2003 (DE) ..... 103 55 032

(51) Int. Cl.
*E03C 1/33* (2006.01)

(52) U.S. Cl. ..... 4/633; 4/631

(58) Field of Classification Search ..... 4/631–634
See application file for complete search history.

(56) References Cited

U.S. PATENT DOCUMENTS 3,284,810 A * 11/1966 Stokes ..... 4/246.1
4,039,077 A 8/1977 Soregson
4,584,822 A 4/1986 Fielding et al.
5,653,550 A 8/1997 Mutz et al.
RE37,253 E 7/2001 Moren et al.
6,308,351 B1 10/2001 Franke
6,382,422 B1 5/2002 Bocek
6,745,416 B2 * 6/2004 Albarran ..... 4/633
D508,555 S 8/2005 Ziemann
D518,881 S 4/2006 Ziemann (Continued)

FOREIGN PATENT DOCUMENTS

DE 1920893 A 11/1970

(Continued)

OTHER PUBLICATIONS

International Search Report from Parent Application No. PCT/EP2004/012840 (5 pages).

(Continued)

*Primary Examiner*—Khoa D Huynh
(74) *Attorney, Agent, or Firm*—Hanley, Flight & Zimmerman, LLC

(57) ABSTRACT

In order to provide a sink, comprising at least one basin, which is provided with a basin flange at its upper edge, a cover, which is fixed to the basin and at least partially covers the basin flange, and at least one holding element on the sink side, which cooperates with a holding element on the worktop side when the sink is fitted, in order to hold the sink on a worktop, in the production of which no after-treatment of visible faces of the sink is necessary and in which the cover can be freely designed and, in particular, can be configured without a dent, it is proposed that the holding element on the sink side is connected to the basin flange.

15 Claims, 12 Drawing Sheets

U.S. PATENT DOCUMENTS

| | | | |
|---|---|---|---|
| 2003/0041374 | A1 | 3/2003 | Franke |
| 2004/0078892 | A1 | 4/2004 | Albarran |
| 2005/0205193 | A1 | 9/2005 | Von Mertz |
| 2005/0263427 | A1 | 12/2005 | Schneider et al. |

FOREIGN PATENT DOCUMENTS

| | | | |
|---|---|---|---|
| DE | 1628684 | | 12/1970 |
| DE | 2640935 | A1 | 3/1977 |
| DE | 2813088 | A | 10/1979 |
| DE | 78 20 319 | U1 | 12/1979 |
| DE | 3 110 134 | | 10/1982 |
| DE | 3925590 | A | 2/1991 |
| DE | 4241023 | A | 6/1994 |
| DE | 4437630 | C1 | 1/1996 |
| DE | 296 20 839 | U1 | 3/1997 |
| DE | 298 22 399 | U1 | 4/1999 |
| EP | 0685021 | B1 | 12/1995 |
| EP | 0 709 528 | | 5/1996 |
| EP | 0 976 881 | | 2/2000 |
| EP | 1 103 665 | | 5/2001 |
| EP | 1188685 | A2 | 3/2002 |
| FR | 1319427 | | 3/1963 |
| FR | 2 430 532 | | 7/1979 |
| FR | 2 832 440 | | 5/2003 |
| GB | 2 108 195 | A | 5/1983 |
| GB | 2263060 | A | 7/2006 |
| JP | 63212682 | | 11/1988 |
| JP | 10029684 | | 2/1998 |
| NL | 8201555 | | 11/1983 |

OTHER PUBLICATIONS

Office action of German Patent Office in German Priority Application 103 55 032.1 (2 pages).
International Search Report corresponding to International Application Serial No. PCT/EP2004/007830, Oct. 5, 2004, 3 pages.
Ziemann, Brigitte, U.S. Appl. No. 29/225,634, filed Mar. 18, 2005 for "Sink." Abandoned.
Schneider, Wolfgang et al., U.S. Appl. No. 11/140,830, filed May 31, 2005 for "Built-Under Sinks."
Schneider, Wolfgang et al., U.S. Appl. No. 29/240,298, filed Oct. 11, 2005 for "Sink."
Ziemann, Brigitte, U.S. Appl. No. 29/242,626, filed Nov. 10, 2005 for "Sink Performa K3 30 Single Bar."
Ziemann, Brigitte, U.S. Appl. No. 29/242,523, filed Nov. 10, 2005 for "Sink Performa K3 30 Double."
Ziemann, Brigitte, U.S. Appl. No. 29/242,581, filed Nov. 10, 2005 for "Sink Performa K3 30 1.5."
Ziemann, Brigitte, U.S. Appl. No. 29/242,618, filed Nov. 10, 2005 for "Sink Performa K4 2.0 Small."
Ziemann, Brigitte, U.S. Appl. No. 29/242,607, filed Nov. 10, 2005 for "Sink Performa K4 1.0 Large."
Ziemann, Brigitte, U.S. Appl. No. 29/242,608, filed Nov. 10, 2005, for "Sink Performa K4 1.0 Super Single."
Ziemann, Brigitte, U.S. Appl. No. 29/242,611, filed Nov. 10, 2005, for "Sink Performa K4 1.5."
Ziemann, Brigitte, U.S. Appl. No. 29/242,627, filed Nov. 10, 2005, for "Sink Performa K4 1.75."
Ziemann, Brigitte, U.S. Appl. No. 29/242,600, filed Nov. 10, 2005, for "Sink Performa V2 33 1.75 Left."
Ziemann, Brigitte, U.S. Appl. No. 29/242,599, filed Nov. 10, 2005, for "Sink Performa V2 Big Single."
Ziemann, Brigitte, U.S. Appl. No. 29/242,610, filed Nov. 10, 2005, for "Sink Performa V2 Double."
Ziemann, Brigitte, U.S. Appl. No. 29/242,612, filed Nov. 10, 2005, for "Sink Performa V2 Single Bar."
Von Mertz et al., U.S. Appl. No. 11/321,683, filed Dec. 28, 2005, for "A Movement Mechanism Moving a Closure Element for the Purposes of Sealing a Waste Outlet Opening."
Schneider, Wolfgang et al., U.S. Appl. No. 29/256,748, filed Mar. 24, 2006, for "Singk."
European Patent Office Search Report for European Patent Application No. 04 012 865.4, Nov. 3, 2004 (3 pages).
European Patent Office Search Report for European Patent Application No. 04 012 866.2, Nov. 12, 2004 (3 pages).
Von Mertz, Gert Spruner, U.S. Appl. No. 11/057,961, filed Aug. 13, 2003, for "Installation Elements and Methods for fastening an Installation Element to a Work Surface."
Schneider, Wolfgang et al., U.S. Appl. No. 10/872,855, filed Jun. 21, 2004, for "Packaging for a Sink."
Mück, Manfred "Attachment Device for an Element Embedded into a Plate", English translation of French Patent Application No. 79 17672 and publication No. 2 430 532, filed Jul. 6, 1979, 7 pages.

* cited by examiner

APPARATUS FOR FITTING A SINK TO A WORKTOP

RELATED APPLICATION

This application is a continuation application of PCT/EP2004/012840 filed Nov. 12, 2004, the entire specification of which is incorporated herein by reference.

FIELD OF THE DISCLOSURE

The invention relates to a sink, which comprises at least one basin, which is provided at its edge with a basin flange, a cover, which is fixed to the basin and at least partially covers the basin flange, and at least one holding element on the sink side, which cooperates with a holding element on the worktop side when the sink is fitted, in order to hold the sink on a worktop.

BACKGROUND

Multi-part sinks of this type are known from the prior art.

In the known multi-part sinks, the holding elements on the sink side, for example fixing brackets, are fixed to the underneath of the cover, in particular welded on.

If a fixing bracket is welded directly to the cover, this results, however, in the fact that the surface of the cover has to be sanded to eliminate the tarnishes and the deformations caused by the welding.

A method is known from EP 0 685 021 B1, in which a fixing bracket can be welded to the underneath of an edge region of a sink without a subsequent after-treatment of the surface of this edge region being necessary. However, for this purpose, the fixing bracket has to be welded to the sink in a convexly curved transition zone, via which the edge region of the sink merges into regions of the sink which are located further inside and deeper than the edge zone. If this solution were to be transferred to a multi-part sink with a cover, this cover would have to be shaped in a special manner, in particular provided with a depression (so-called "Spiegel" (German technical term)) in order to be able to use this method.

It is also known from DE 26 40 935 A1 to weld a holding element on the sink side directly to the outside of a basin wall. However, an after-treatment of the surface of the inside of the basin wall, which is visible to the user, is required in every case here after the welding process in order to eliminate tarnishes and deformations occurring during the welding. Moreover, if the holding element on the sink side is directly connected to the basin wall, a visible deformation of the basin wall occurs when forces are introduced into the holding element on the sink side by means of the holding element on the worktop side when the sink is braced to a worktop.

The present invention is therefore based on the object of providing a sink of the type mentioned at the outset, in the production of which no after-treatment of visible faces of the sink is necessary and in which the cover can be freely designed, and can, in particular, be configured without a dent.

SUMMARY OF THE INVENTION

This object is achieved according to the invention in a sink with the features of the preamble of claim 1 in that the holding element on the sink side is connected to the basin flange.

Since, according to the solution according to the invention, the holding element on the sink side is connected directly to a region of the basin flange, which is covered by the cover and is therefore not visible to the user of the sink during operation of the sink, an after-treatment of the sink at the point at which the holding element on the sink side is fastened, can be omitted in every case.

At the same time, since the holding element on the sink side is connected to the basin flange and not to a basin wall, visible deformation of the basin wall is avoided during fixing of the sink to a worktop.

Furthermore, the cover of the sink according to the invention can be freely designed and does not have to have in particular a depression (so-called "Spiegel" (German technical term)) in order to be able to fix a holding element to the sink without refinishing.

The cover of the sink according to the invention may, in particular, have a substantially flat upper side.

In a preferred configuration of the sink according to the invention it is provided that the holding element on the sink side is configured in one piece with the basin flange. This eliminates the work step of fixing the holding element on the sink side to another component of the sink.

In particular, it may be provided that the holding element on the sink side merges into the basin flange along a bending line. The holding element on the sink side may thus be formed, in particular, in that a lug connected in one piece to the basin flange is formed by bending processes into the holding element on the sink side.

As an alternative to this, it may also be provided that the holding element on the sink side is configured as a separate part from the basin flange and is fixed, preferably permanently, to the basin flange.

This solution offers the advantage that the material of the holding element on the sink side can be selected independently from the material of the basin flange.

In particular, the material thickness of the holding element on the sink side can be selected independently from the material thickness of the basin flange.

A holding element of this type on the sink side, produced as a separate component from the basin flange can basically be joined by any suitable method to the basin flange, for example by riveting, latching or the like.

In particular, it may be provided that the holding element on the sink side is welded and/or glued to the basin flange.

It has proven to be particularly favourable if the holding element on the sink side is fixed to a holding region of the basin flange, which is substantially horizontally oriented when the sink is fitted.

The cover of the sink according to the invention is preferably configured without a depression, in other words does not have a so-called "Spiegel" (German technical term).

The holding element on the sink side may basically have any desired design.

It is preferably provided that the holding element on the sink side is configured as a fixing bracket.

In order to be able to easily connect the holding element on the sink side to a holding element on the worktop side when the sink is being fitted to a worktop, it is favourable if the holding element on the sink side has a latching element, in particular a latching window for latching to the holding element on the worktop side.

Instead of a latching window, a latching projection may also be provided as a latching element, which, when the sink is fitted, latches to a latching element of the holding element on the worktop side.

It may also be provided that the holding element on the sink side and on the worktop side do not latch to one another, but are connected to one another by hooking in or in another manner.

Claim 11 is directed to the combination of a sink according to the invention and at least one holding element on the worktop side.

The holding element on the worktop side preferably has a latching element, which can be latched to a latching element, in particular a latching window or a latching projection, of a holding element on the sink side.

It is also advantageously provided that the holding element on the worktop side has a support element, which is supported on a worktop when the sink is fitted.

In order to be able to brace the sink to the worktop by means of the holding element on the worktop side, it is favourable if the holding element on the worktop side has a clamping element, in particular a clamping screw.

Further features and advantages of the invention are the subject of the following description and the view of embodiments in the drawings.

BRIEF DESCRIPTION OF THE DRAWINGS

The same or functionally equivalent elements are designated by the same reference numerals in all the figures.

DETAILED DESCRIPTION OF PARTICULAR EMBODIMENTS OF THE INVENTION

Figure 5:
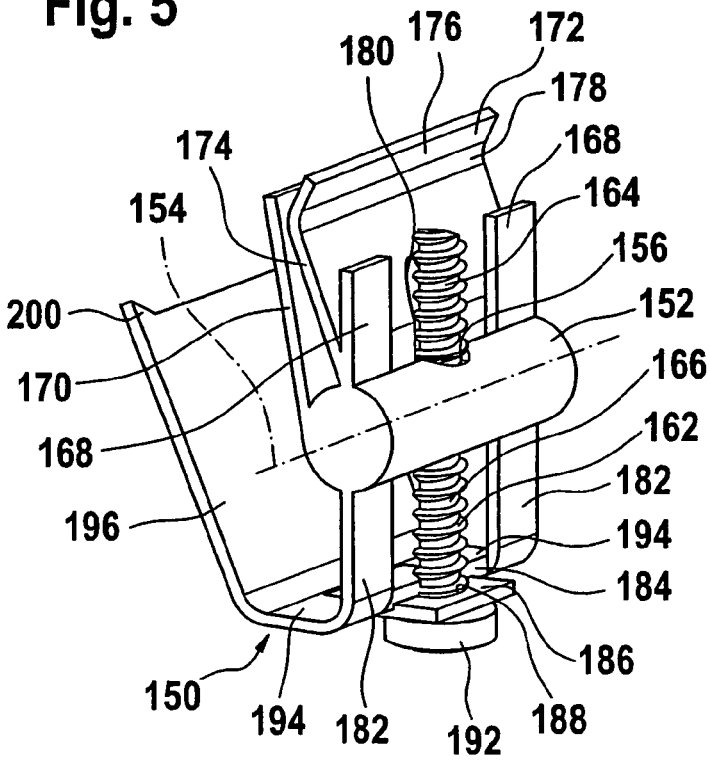
FIG. 5 shows a schematic perspective view of the holding element on the worktop side, viewed from the side facing the basin wall of the sink when the sink is fitted.
Figure 6:
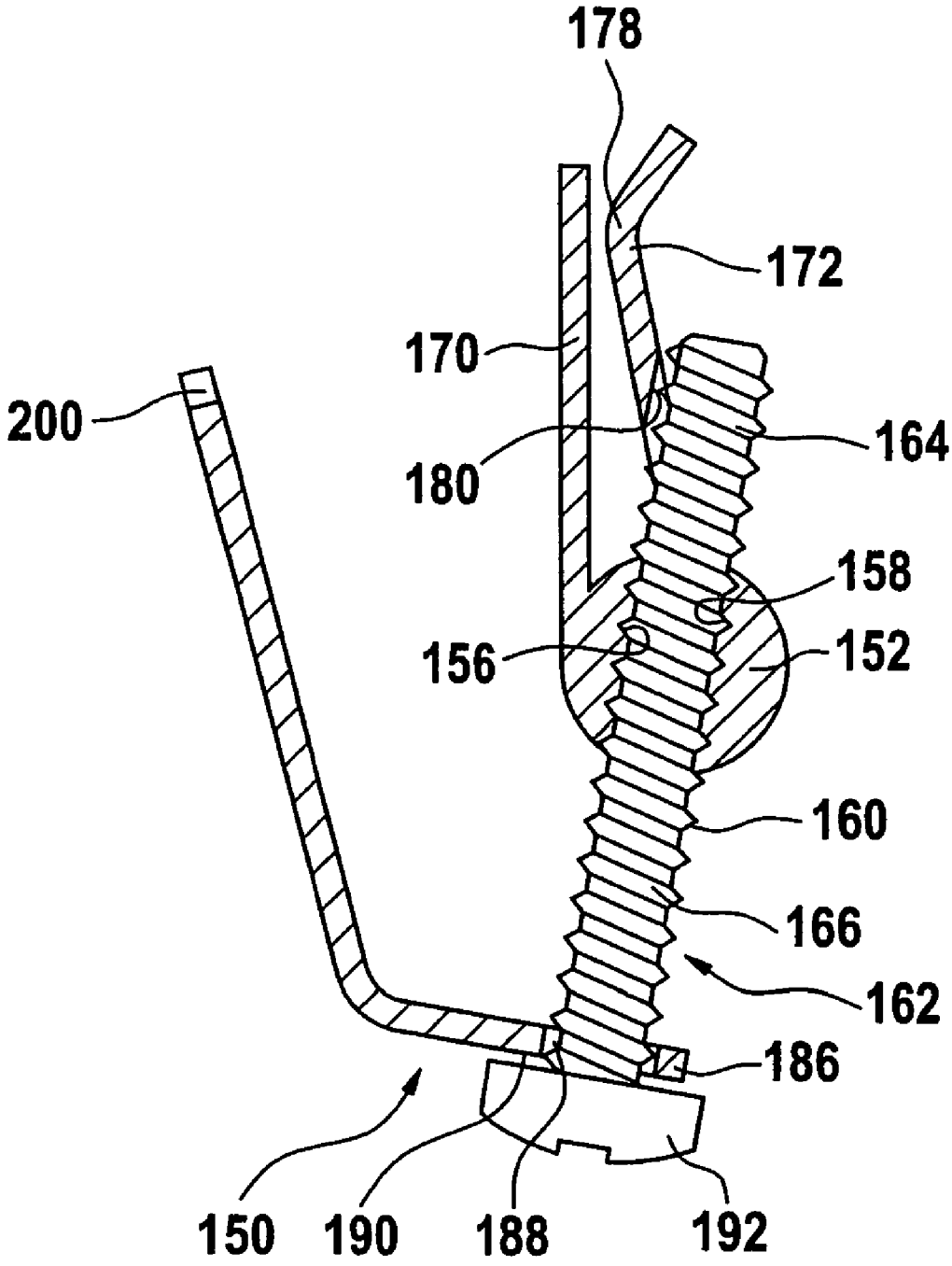
FIG. 6 shows a schematic view through the holding element on the worktop side from FIGS. 4 and 5.
Figure 7:
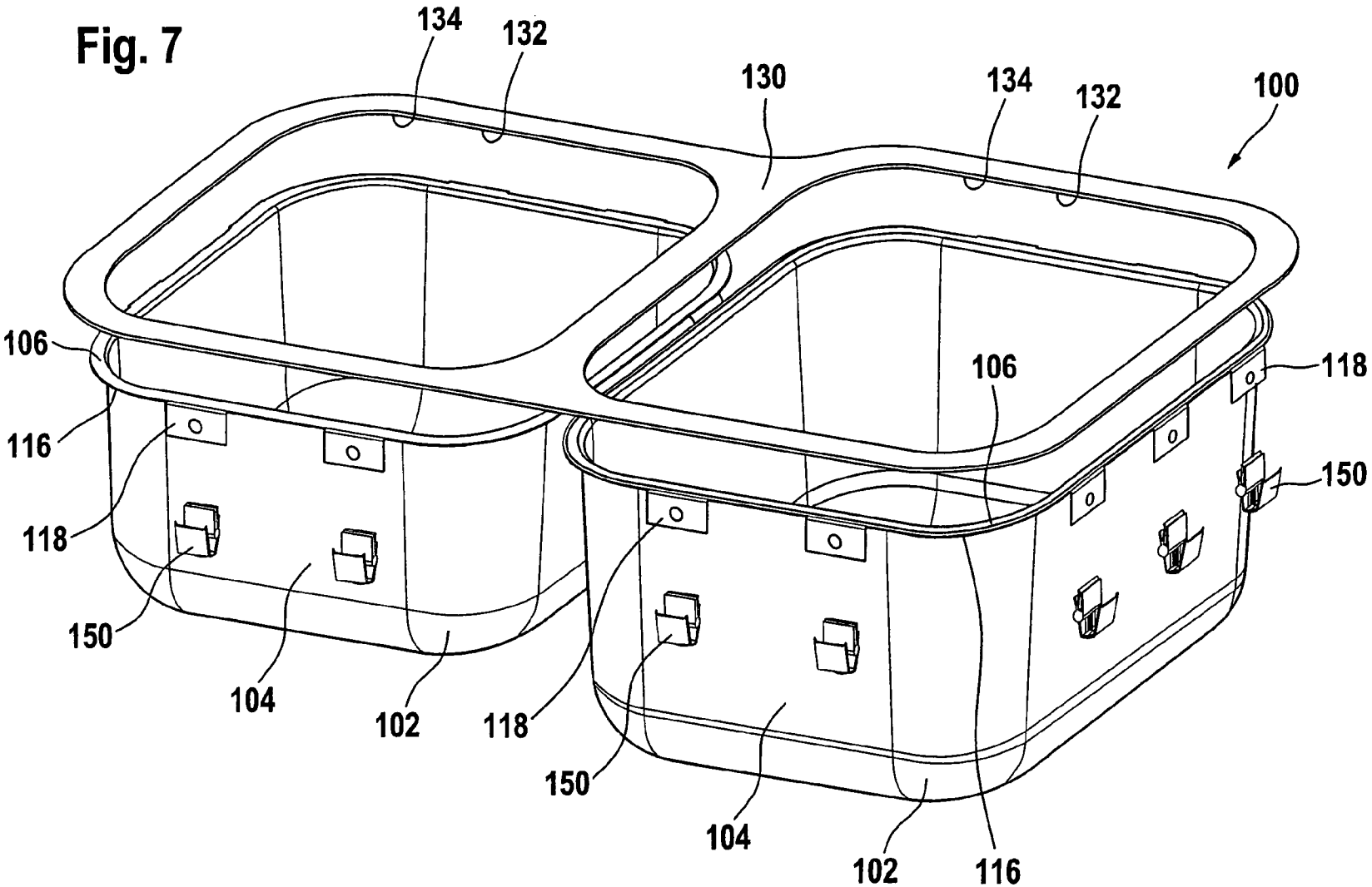
FIG. 7 shows a schematic perspective view of a sink comprising two basins, on the basin flanges of which holding elements on the sink side are moulded on, and comprising a cover and holding elements on the worktop side, the cover and the holding elements on the worktop side not yet being connected to the basin.
Figure 8:
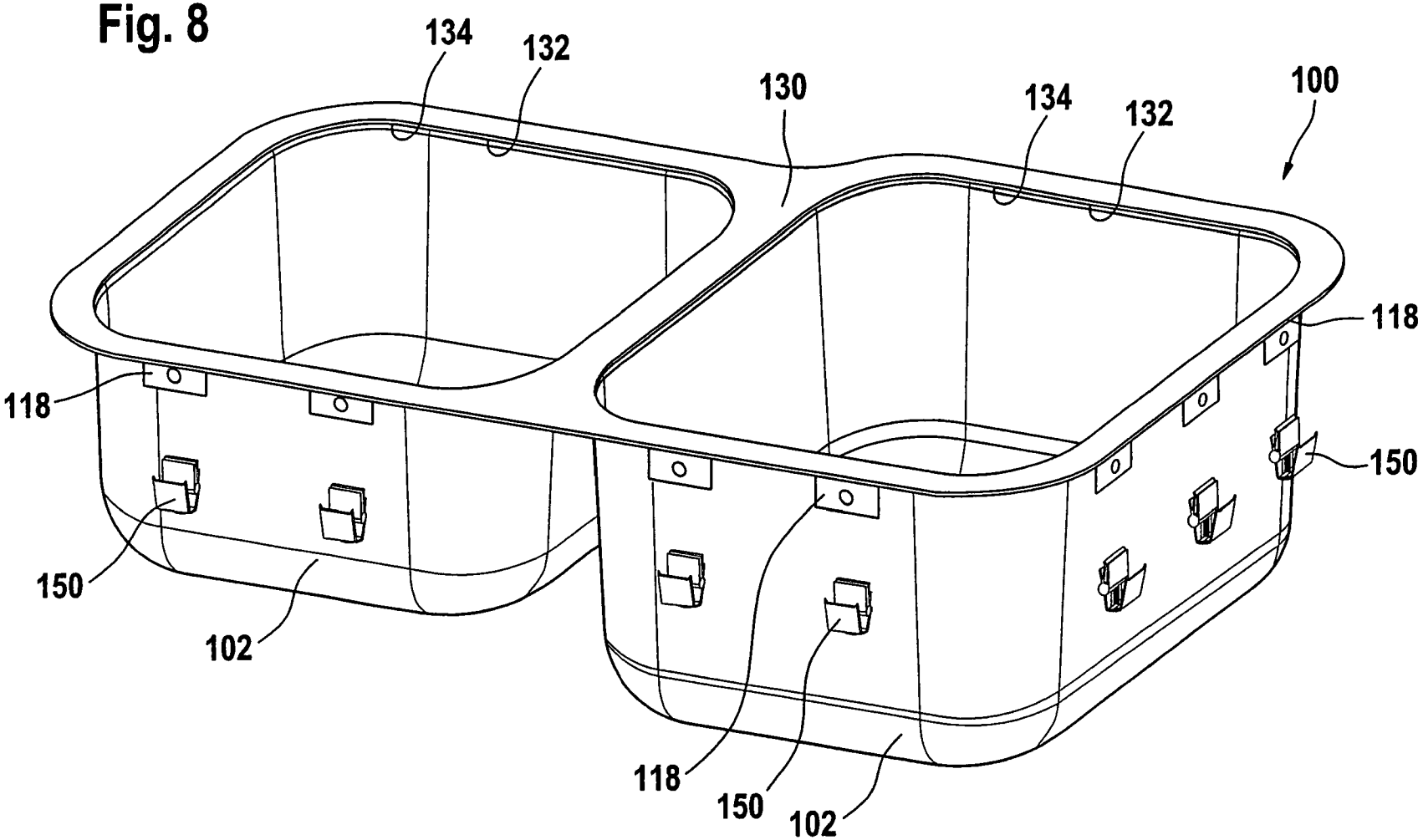
FIG. 8 shows a perspective view corresponding to FIG. 7, with the cover having been connected to the basin flanges.
Figure 9:
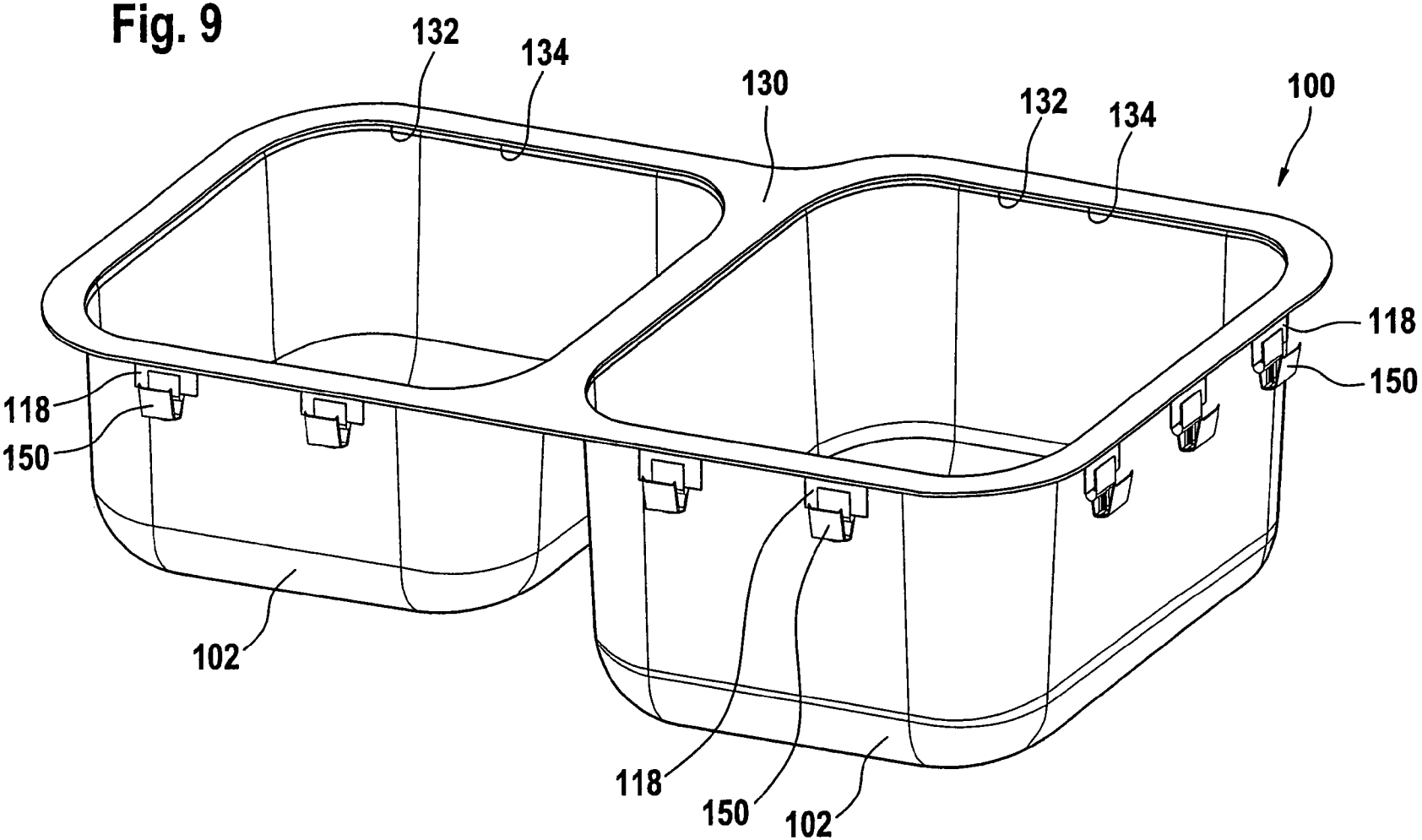
FIG. 9 shows a perspective view corresponding to FIG. 8, with the holding elements on the worktop side having been latched to the holding elements on the sink side.

A sink designated by 100 as a whole and shown in FIGS. 1 to 9 comprises, as can be seen best from FIG. 7, two basins 102, which in each case comprise a basin base with a discharge aperture (not shown), four basin walls 104 extending up from the basin substantially vertically upwardly and a basin flange 106 extending peripherally along the upper edges of the basin walls 104.

Figure 2:
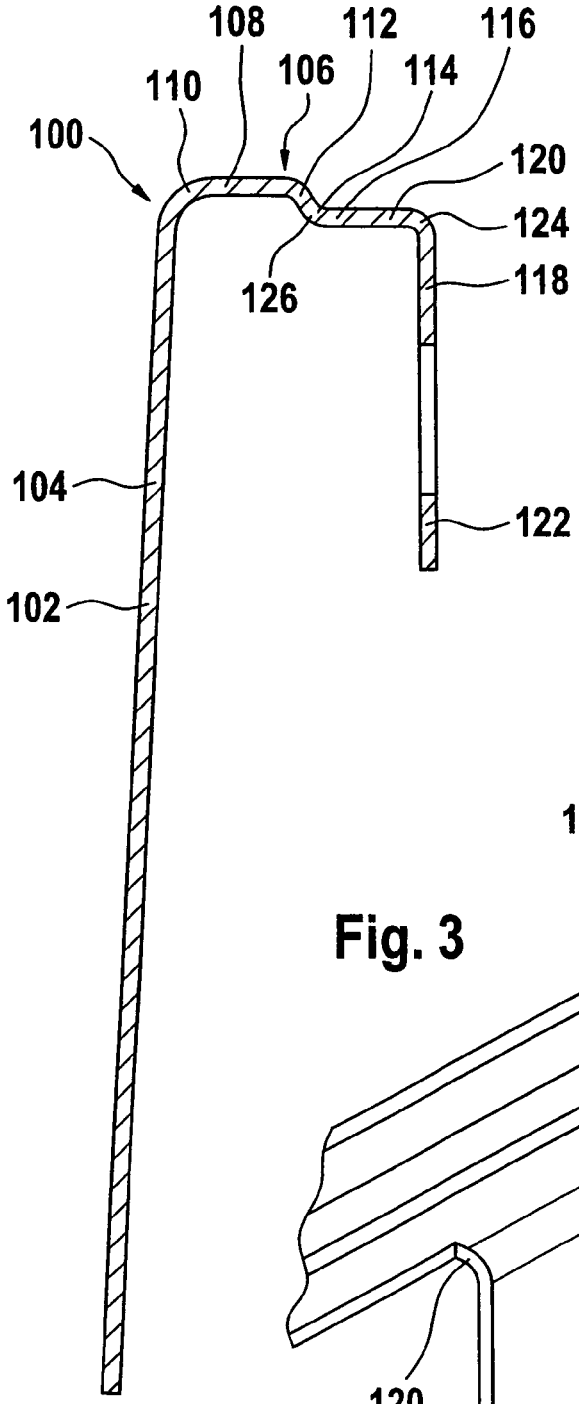
FIG. 2 shows a schematic section through a basin wall, a basin flange and a holding element on the sink side of the sink from FIG. 1.
Figure 3:
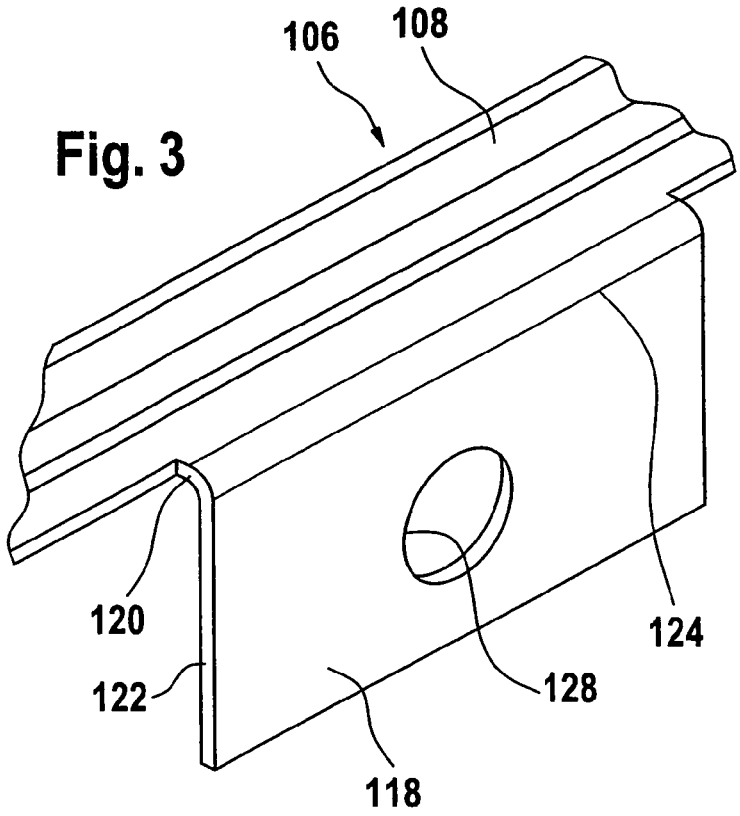
FIG. 3 shows a schematic perspective view of a holding element on the sink side of the sink from FIGS. 1 and 2.

As can be seen best from FIG. 2, each basin flange 106 comprises a support region 108 oriented substantially horizontally (when the sink 100 is fitted), which merges at its inner edge along a bending line 110 into the basin wall 104 and at its outer edge along a bending line 112 into a bevel 114 of the basin flange 106 dropping away outwardly.

As can be seen best from FIG. 7, a plurality of holding elements 118 on the sink side, which are spaced apart from one another in the longitudinal direction of the basin flange 106, are moulded onto the outer edge 116 of the bevel 114 of the basin flange 106.

As can be seen best from FIG. 2, each of the holding elements 118 on the sink side has a substantially L-shaped cross-section, with a substantially horizontally oriented short leg 120, when the sink 100 is fitted, and a substantially vertically oriented long leg 122, when the sink 100 is fitted, which, along a bending line 124 adjoins the outer edge of the short leg 120.

The short leg 120 passes, at its inner edge, along a bending line 126, into the bevel 114 of the basin flange 106.

In this embodiment, the holding elements 118 on the sink side, are therefore configured in one piece with the respectively associated basin flange 106.

The holding elements 118 on the sink side may in particular be produced in that a basin preform is cut out of a material provided for the basin 102, for example from a special stainless steel, the desired shape of the basin 102 with the peripheral basin flange 106 is produced from this preform by deep drawing and then the holding elements 118 on the sink side are brought into their final form by bending along the above-described bending lines 124 and 126.

The long leg 122 of each holding element 118 on the sink side is provided with a latching window 128 in the form of a through-aperture, which is for example cylindrical.

As can be seen from FIG. 7, the sink 100 also comprises a cover 130 in the form of a substantially level plate, which has a respective through-aperture 132 for each basin 102, the contour of which through-aperture substantially corresponds to the course of the inner edge of the support region 108 of the basin flange 106 of the respectively associated basin 102.

The outer contour of the cover 130 follows the contours of the through-aperture 132 at a predetermined spacing.

The cover 130 is connected to the basins 102, in that it is placed on the support regions 108 of the basin flanges 106 and is welded to the basin flanges 106 along the edges 134 of the through-apertures 132.

Figure 1:
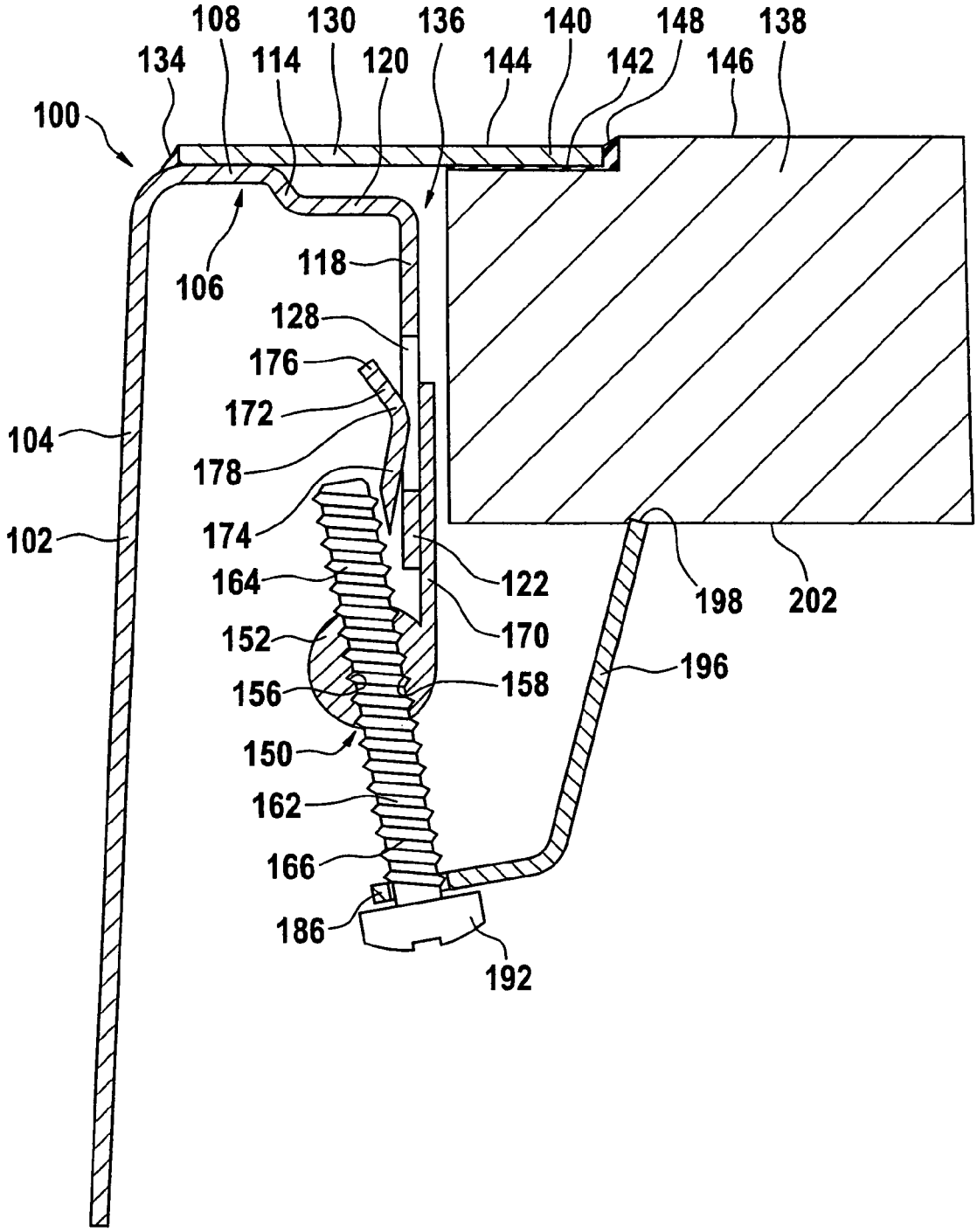
FIG. 1 shows a schematic cross-section through an edge region of a built-in sink, a holding element on the sink side and a holding element on the worktop side, by means of which the sink is held on a worktop.

The sink 100 produced by connecting the cover 130 to the basins 102, is inserted from above as a whole into a receiving aperture 136, which is adapted to the outer contour of the sink 100, in a worktop 138 (see FIG. 1).

In this case, the outer edge region 140 of the cover 130 is placed in a recess 142 extending around the receiving aperture 136 on the upper side 146 of the worktop 138, so the upper side 144 of the cover 130 lies slightly deeper than the upper side 146 of the worktop 138.

In order to prevent water being able to reach the region below the sink 100 from the upper side of the sink or the worktop, a bead 148 made of a sealing material, for example a silicone material is arranged between the outer edge region 140 of the cover 130 and the outer edge of the recess 142 in the worktop 138.

Figure 4:
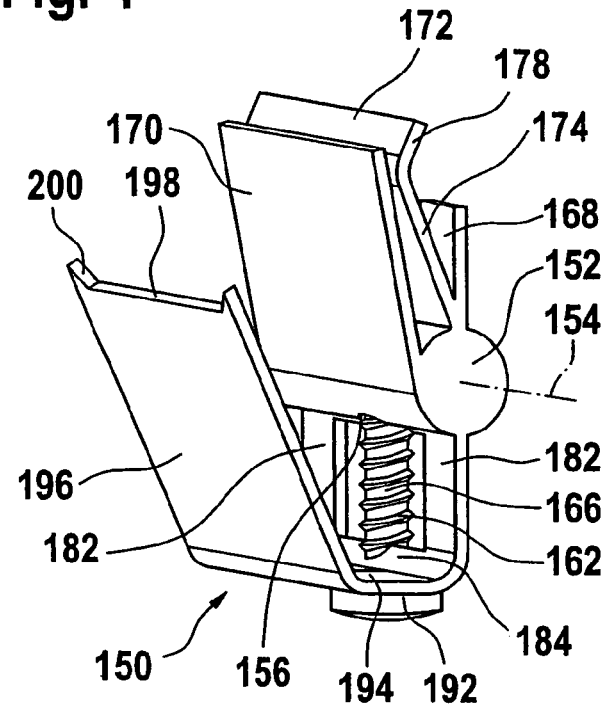
FIG. 4 shows a schematic perspective view of a holding element on the worktop side, viewed from the side remote from the basin wall of the sink, when the sink is fitted.

In order to fix the sink 100 to the worktop 138 in such a way that it can no longer be removed upwardly from the receiving aperture 136, the holding elements 118 on the sink side are braced by means of holding elements 150 on the worktop side, of which one is shown in FIG. 4 to 6, against the worktop 138.

Each of the holding elements 150 on the worktop side comprises a substantially cylindrical central part 152 with a centre axis 154, which is substantially horizontally oriented (when fitted).

The centre part 152 is penetrated by a centrally arranged and radially oriented through-aperture 156, which is provided with an internal thread 158.

An external thread 160 of a clamping screw 162 is screwed into the internal thread 158 of the through-bore 156.

An upper shank part 164 of the clamping screw 162 extends upwardly beyond the upper end of the through-bore 156, while a lower shank part 166 of the clamping screw 162 extends downwardly beyond the lower end of the through-bore 156.

As can be seen best from FIG. 5, an upper guide leg 168 of the holding element 150 on the worktop side extends, in each case, on either side of the upper shank part 164 of the clamping screw 162 in a radial direction of the centre part 152.

A contact plate 170 also extends upwardly in a tangential direction of the centre part 152 from the peripheral face of the centre part 152.

Arranged between the upper guide legs 168, on the one hand, and the contact plate 170, on the other hand, is a latching plate 172, which comprises a lower section 174, which is moulded onto the lower ends of the guide legs 168 and extends from these, obliquely to the radial direction of the centre part 152 in the direction of the contact plate 170 and an upper section 176, which passes at its lower edge along a latching rim 178 into the lower section 174, and extends from the latching rim 178, obliquely to the radial direction of the centre part 152, away from the contact plate 170.

As can be seen best from FIG. 5, the lower section 174 of the latching plate 172 has a recess 180 in order to allow the upper shank part 164 of the clamping screw 162 to pass through the latching plate 172.

Two lower guide legs 182 extend downwardly from the lower region of the peripheral face of the centre part 152 on either side of the lower shank part 166 of the clamping screw 162 in a radial direction of the centre part 152 opposed to the longitudinal direction of the upper guide legs 168 and are connected to one another at their lower ends by a web 184.

A clamping plate 186, which has a through-aperture 188 for the lower shank part 166 of the clamping screw 162 to pass through extends away from this web 184 and a screw head 192 of the clamping screw 162 rests on the lower side 190 thereof when the sink 100 is fitted.

Two holding plates 194 project from the web 184 in a direction opposed to the clamping plate 186 and bear, on their edges remote from the web 184, a support plate 196, which extends upwardly from the holding plates 194 obliquely to the direction of the guide legs 168, 182 and bears two indentations 200 at its upper edge 198.

The components described above of the holding elements 150 on the worktop side, may (with the exception of the clamping screw 162) be configured as a one-piece moulding made of a plastics material, which is produced for example, by an injection moulding method.

In order to fit the sink 100 by means of the holding elements 150 on the worktop side to the worktop 138, a holding element 150 on the worktop side is pushed in each case from below the sink 100 onto each of the holding elements 118 on the sink side in such a way that the contact plate 170 of the holding element 150 on the worktop side rests on the outside of the long leg 122 of the respective holding element 118 on the sink side, which is remote from the basin 102, and the latching plate 172 of the holding element 150 on the worktop side engages with its latching rim 178 in the latching window 128 of the holding element 118 on the sink side, so the holding element 150 on the worktop side is latched to the holding element 118 on the sink side.

The support plate 196 is then arranged on the underneath 202 of the worktop 138.

By screwing the clamping screw 162 further into the internal thread 158 of the through-bore 156 of the centre part 152 of the holding element 150 on the worktop side, the upper edge 198 of the support plate 196 is pressed against the underneath 202 of the worktop 138, the indentations 200 at the upper edge 198 of the support plate 196 being able to sink into the worktop 138.

By tightening the clamping screw 162, the holding element 118 on the sink side being latched to the relevant holding element 150 on the worktop side is also pulled downwardly, so the cover 130 connected to the basin flange 106 is pulled against the upper side of the worktop 138 and therefore the sink 100 is braced as a whole against the worktop 138.

To release the sink 100 from the worktop 138, the clamping screws 162 of the holding elements 150 on the worktop side are screwed out of the through-bores 156 of the respective centre parts 152 to such an extent that the support plates 196 are released from the worktop 138 and the holding elements 150 on the worktop side can be pulled downwardly from the holding elements 118 on the sink side, whereupon the sink 100 can be lifted upwardly out of the receiving aperture 136 of the worktop 138.

A second embodiment of a sink 100 shown in FIGS. 10 to 16 differs from the first embodiment described above only in that the holding elements 118 on the sink side are not moulded in one-piece to the basin flanges 106, but instead are produced as separate fixing brackets 204 and then fastened to the basin flanges 106.

Figure 10:
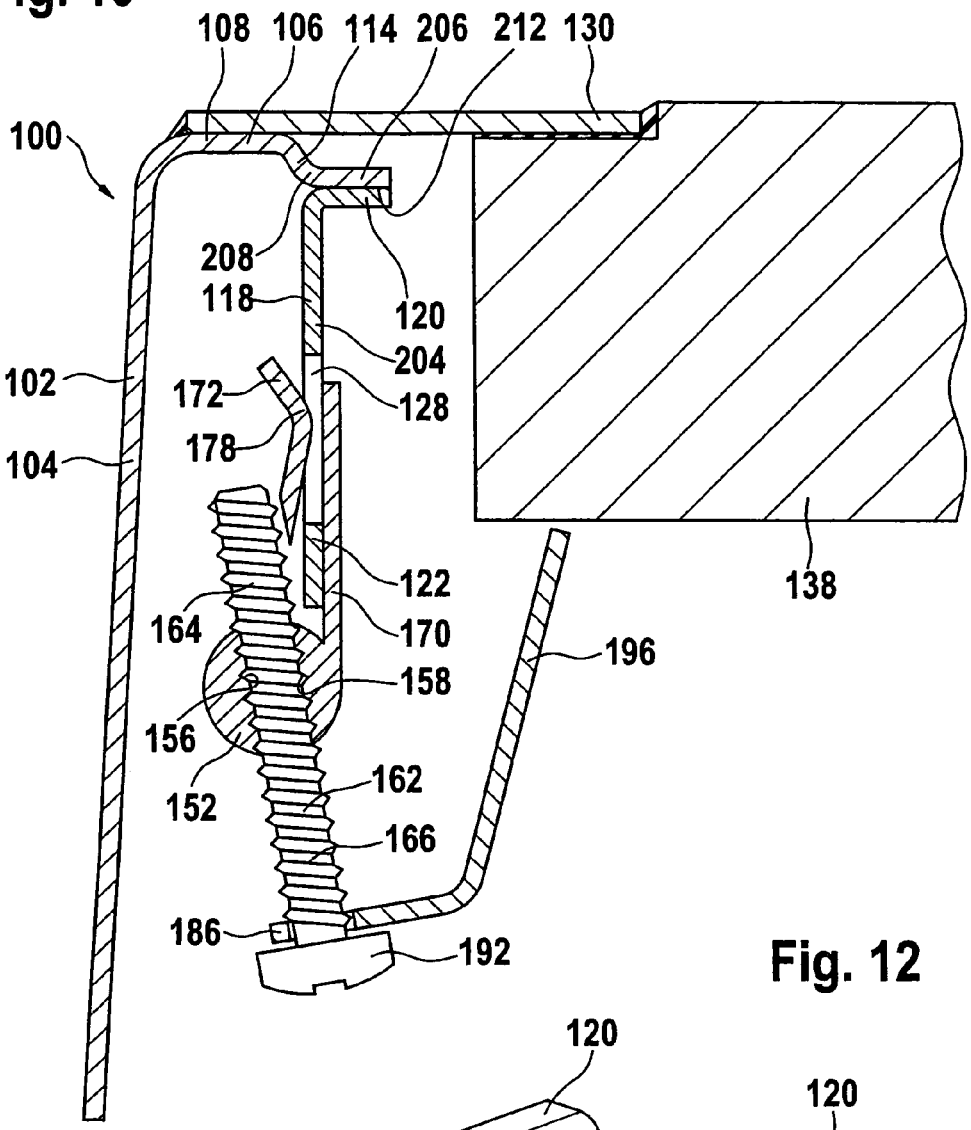
FIG. 10 shows a schematic cross-section through a basin wall, a basin flange, a holding element on the sink side, a holding element on the worktop side and a cover in a second embodiment of a sink, in which the holding element on the sink side is configured as a separate part from the basin flange and is fixed to a horizontal holding region of the basin flange.

As can be seen best from FIG. 10, each basin flange 106 has for this purpose, apart from the support region 108 and the bevel 114, a substantially horizontal holding region 206, which passes along a bending line 208 into the bevel 114 of the basin flange 106.

Figure 12:
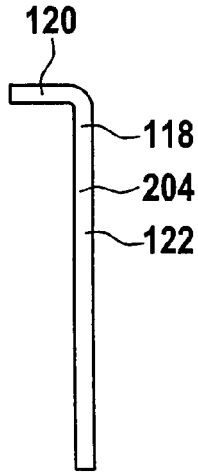
FIG. 12 shows a schematic side view of the holding element on the sink side, of the second embodiment.
Figure 11:
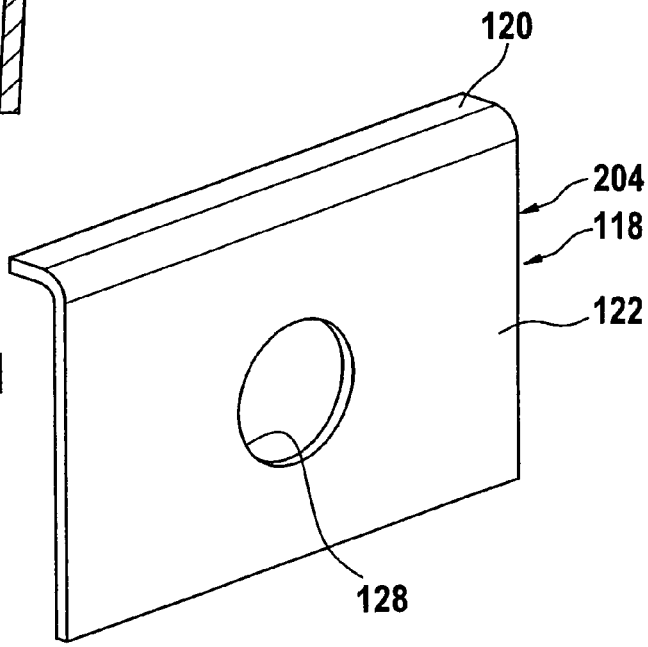
FIG. 11 shows a schematic perspective view of the holding element on the sink side, of the second embodiment.
Figure 13:
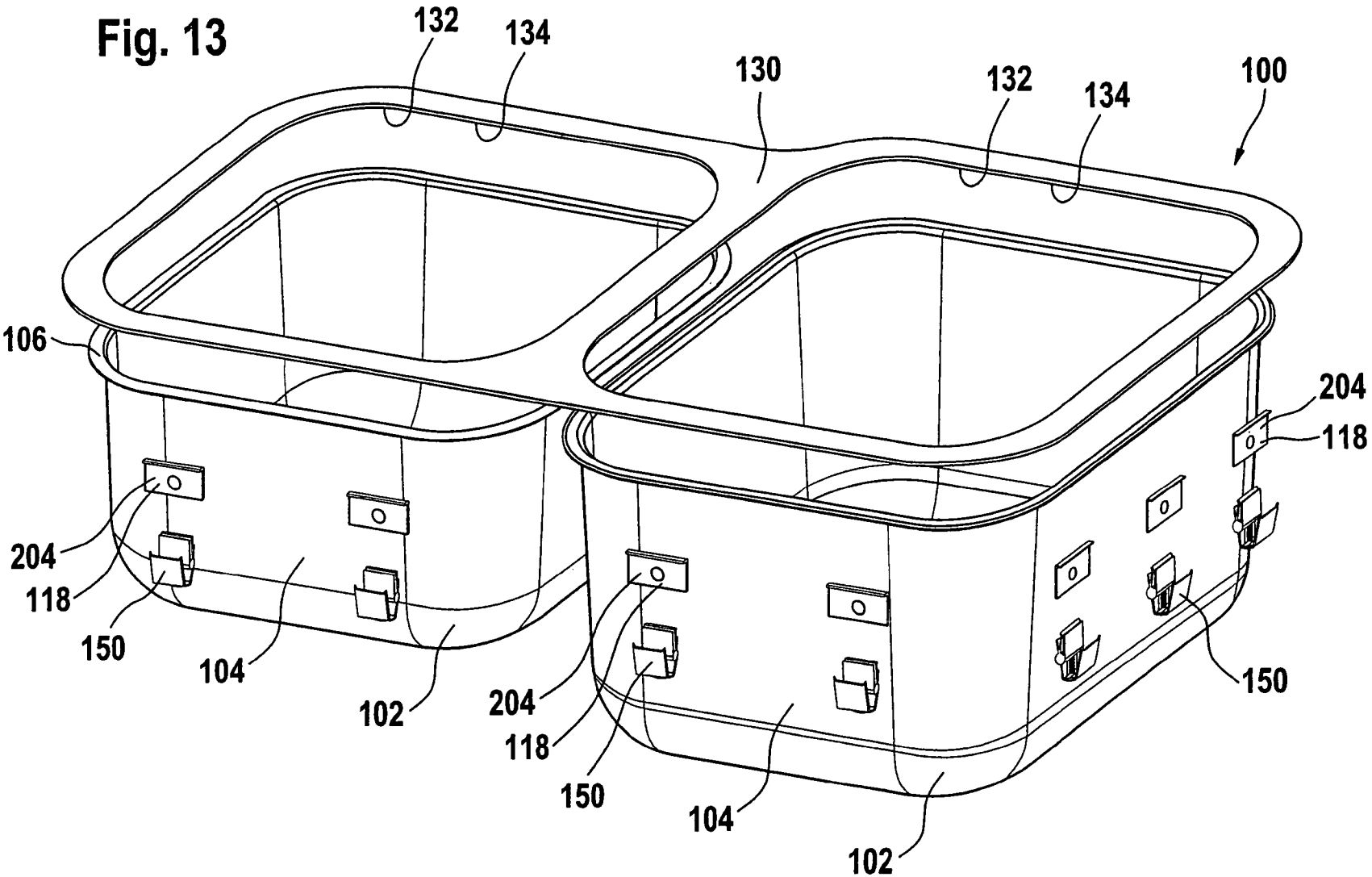
FIG. 13 shows a schematic perspective view of the second embodiment of a sink, with two basins, a cover, a plurality of holding elements on the sink side and a plurality of holding elements on the worktop side, the cover, the holding elements on the sink side and the holding elements on the worktop side still being separate from the basins.
Figure 14:
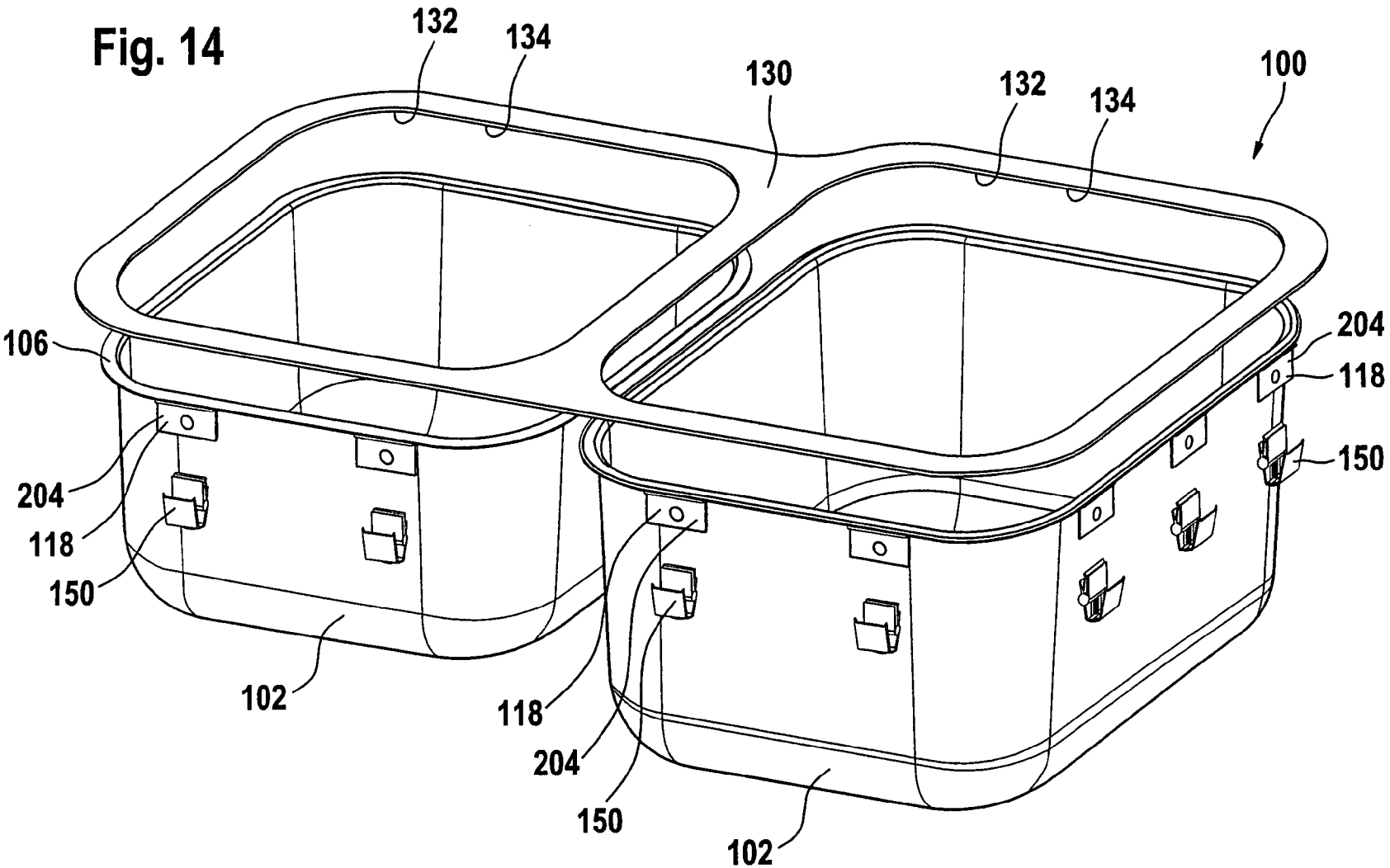
FIG. 14 shows a schematic perspective view corresponding to FIG. 13, the holding elements on the sink side having been fixed to the basin flanges of the basins.
Figure 15:
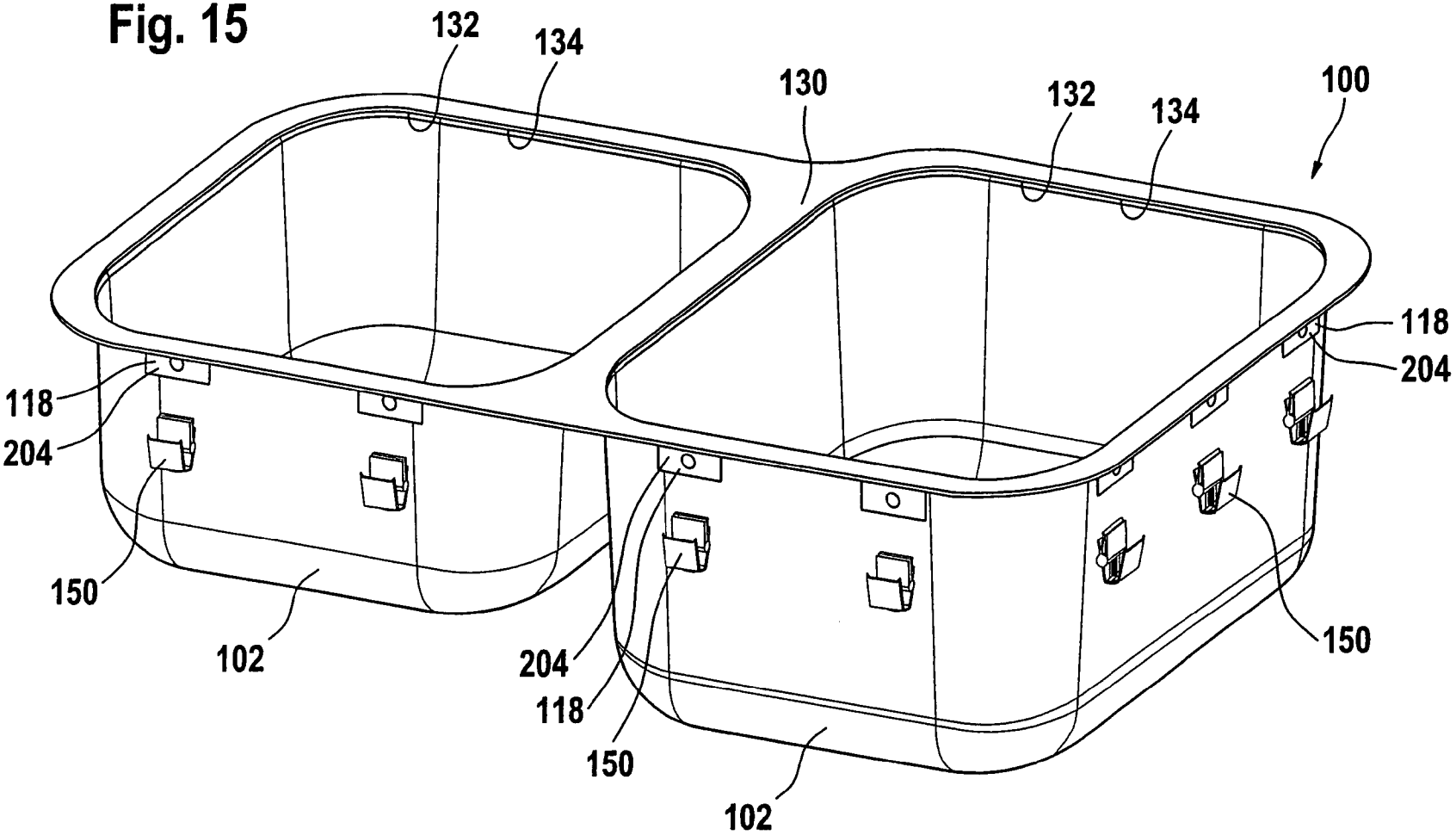
FIG. 15 shows a schematic perspective view corresponding to FIG. 14, the cover having been connected to the basin flanges of the basins.
Figure 16:
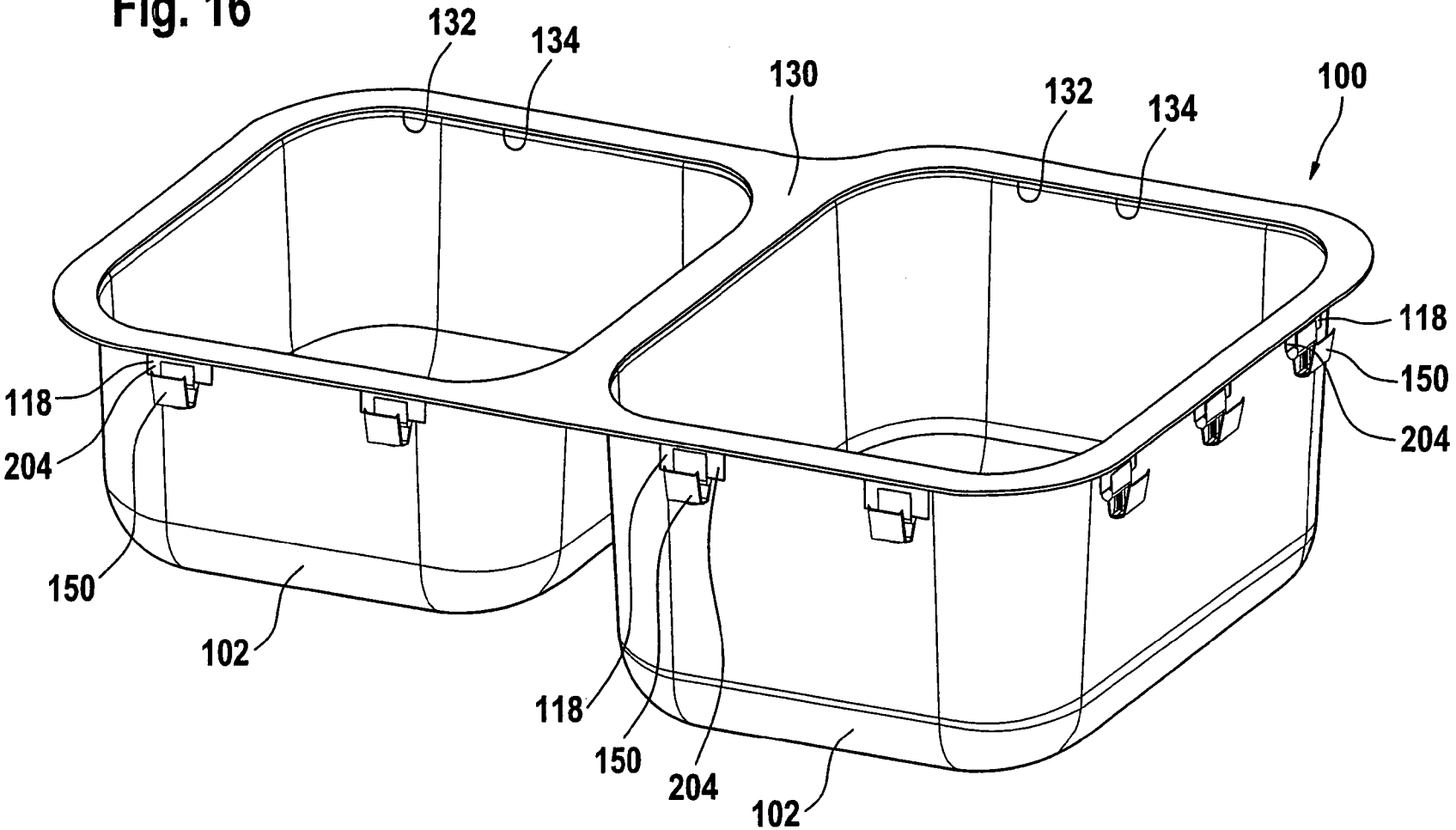
FIG. 16 shows a schematic perspective view corresponding to FIG. 15, the holding elements on the worktop side having been latched to the holding elements on the sink side.

Each of the fixing brackets 204, which are configured as separate components from the basin flanges 106, comprises, as can be seen from FIGS. 11 and 12, like the holding elements 118 on the sink side, of the first embodiment, a horizontal short leg 120 in each case, and a vertical long leg 122 with a latching window 128.

The cross-sectionally L-shaped fixing brackets 204 are brought into contact with the upper side 210 of the short leg 120 on the lower side 212 of the holding region 206 of the respectively associated basin flange 106 and connected to the basin flange 106, permanently, for example by gluing and/or welding.

The fixing brackets 204 are preferably oriented here in such a way that the long leg 122 of the fixing bracket 204 faces the basin 102 and is remote from the worktop 138.

Since the fixing bracket 204 is not fixed, in particular welded, to the cover 130, but to the holding region 206 of the basin flange 106 covered by the cover 130, no surface treatment of any type of the cover 130 is required after fastening the fixing brackets 204.

Furthermore, it is not necessary to give the cover 130 a specific shape, in particular comprising recesses, in order to be able to fix the fixing brackets 204 to the sink 100 without impairment of the surface quality of the cover 130.

Moreover, the second embodiment of a sink 100 coincides with respect to structure and function with the first embodiment described above.

In particular, the holding elements 118 on the sink side in the form of fixing brackets 204 can be braced to the worktop 138 in the second embodiment by means of holding elements 150 on the worktop side, which are configured in exactly the same way as in the first embodiment.

To this extent, reference is therefore made to the above description of the first embodiment.

The invention claimed is:

1. A sink, comprising:

at least one basin, which is provided, at its upper edge, with a basin flange;

a cover fastened to and arranged above the basin flange, such that the cover extends peripherally outward from the basin flange and at least partially covers the basin flange; and at least one holding element on a sink side, which cooperates with a holding element on a side of a worktop when the sink is fitted, in order to hold the sink on the worktop, wherein the holding element on the sink side is configured as a separate part from the basin flange and is fastened to the basin flange, and wherein, the holding element on the side of the worktop comprises a support element adapted to contact the worktop and an adjustment element for varying a distance between the cover and the support element such that, upon fitting the sink to the worktop, a distance between the cover and the support element is lessened so that the sink is braced against the worktop.

2. Sink according to claim 1, wherein the holding element on the sink side is permanently fastened to the basin flange.

3. Sink according to claim 1, wherein the holding element on the sink side is fastened to a holding region, which is substantially horizontally oriented when the sink is fitted, of the basin flange.

4. Sink according to claim 2, wherein the holding element on the sink side is welded to the basin flange.

5. Sink according to claim 2, wherein the holding element on the sink side is glued to the basin flange.

6. Sink according to claim 1, wherein the cover is configured without a dent.

7. Sink according to claim 1, wherein the holding element on the sink side is configured as a fixing bracket.

8. Sink according to claim 1, wherein the holding element on the sink side has a latching element for latching to the holding element on the worktop side.

9. Combination of a sink according to claim 1, and at least one holding element on the worktop side.

10. Combination according to claim 9, wherein the holding element on the worktop side has a latching element, which can be latched to a latching element of a holding element on the sink side.

11. Combination according to claim 9, wherein the holding element on the worktop side has a support element, which is supported on a worktop when the sink is fitted.

12. Combination according to claim 9, wherein the holding element on the worktop side has a clamping element, in particular a clamping screw.

13. Sink according to claim 8, wherein the latching element defines a latching window.

14. A sink adapted to be fastened to a worktop having an upper surface and a lower surface generally opposite the upper surface, the sink comprising:

at least one basin having a plurality of basin walls extending substantially vertically upwards from a basin base;

a basin flange extending peripherally outward along at least a portion of the upper edges of the basin walls and having an upper surface;

a cover arranged above the basin flange, extending peripherally outward from the basin flange, and having a first surface fastened to the upper surface of the basin flange, the cover being adapted to rest upon at least a portion of the upper surface of the worktop when the sink is fitted to the worktop such that the upper surface of the basin flange, the first surface of the cover, and the upper surface of the worktop are disposed in substantially parallel planes;

at least one holding element fastened to the basin flange and configured as a separate part from the basin flange;

at least one support plate adapted to contact the lower surface of the worktop;

an adjustment element to adjustably couple the at least one support plate to a respective holding element wherein, upon fitting the sink to the worktop, a distance between the first surface of the cover and the support plate is lessened so that the sink is braced against the worktop.

15. A sink according to claim 1, wherein the cover is welded to the basin flange.

* * * * *